US011506446B2

(12) United States Patent
Staud et al.

(10) Patent No.: US 11,506,446 B2
(45) Date of Patent: Nov. 22, 2022

(54) SHELF WITH SPECIFIC CENTER WEB FOR SEPARATE PLATE ELEMENTS

(71) Applicant: BSH Hausgeraete GmbH, Munich (DE)

(72) Inventors: Ralph Staud, Munich (DE); Thomas Tischer, Haar (DE); Volkan Cakirca, Istanbul (TR); Oezkan Dagci, Tekirdag (TR); Caner Kara, Tekirdag (TR); Fidan Gueler, Istanbul (TR); Oezguer Uysal, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/999,338

(22) Filed: Aug. 21, 2020

(65) Prior Publication Data

US 2021/0055041 A1 Feb. 25, 2021

(30) Foreign Application Priority Data

Aug. 21, 2019 (TR) ..... 2019/12527

(51) Int. Cl.
*F25D 25/02* (2006.01)

(52) U.S. Cl.
CPC ..... *F25D 25/02* (2013.01); *F25D 2325/021* (2013.01); *F25D 2325/022* (2013.01)

(58) Field of Classification Search
CPC ..... F25D 25/02; F25D 2325/022; F25D 2325/021; F25D 25/024; F25D 23/067; A47B 96/025; A47B 2210/175; A47B 96/027; A47B 96/062; A47B 45/00
USPC .... 312/404, 408, 410, 301, 351; 108/17, 63, 108/76, 86, 102, 106–108, 138, 143
See application file for complete search history.

(56) References Cited

U.S. PATENT DOCUMENTS

| | | | | |
|---|---|---|---|---|
| 5,403,083 | A * | 4/1995 | Dasher | A47B 57/40 108/137 |
| 5,813,741 | A * | 9/1998 | Fish | F25D 25/024 108/108 |
| 6,773,651 | B1 | 10/2004 | Goyette et al. | |
| 10,342,335 | B1 * | 7/2019 | Fazi | A47B 57/408 |
| 11,047,617 | B1 * | 6/2021 | Bassler | F25D 25/024 |
| 2003/0020387 | A1 * | 1/2003 | Wing | A47B 96/067 312/408 |

(Continued)

FOREIGN PATENT DOCUMENTS

| | | | |
|---|---|---|---|
| CN | 202216488 | U | 5/2012 |
| DE | 9006675 | U1 | 8/1990 |

(Continued)

*Primary Examiner* — Hiwot E Tefera
(74) *Attorney, Agent, or Firm* — Laurence A. Greenberg; Werner H. Stemer; Ralph E. Locher

(57) ABSTRACT

A shelf for a household refrigeration appliance includes a shelf plate having a first plate element and a separate second plate element. The second plate element is disposed next to the first plate element in a use position in the widthwise direction of the shelf to form the shelf plate and the second plate element can be removed non-destructively to make the shelf plate smaller. A carrier frame only borders the edges of the shelf plate. The shelf has a center web oriented in the depthwise direction of the shelf. Both plate elements rest on the center web in their use position.

19 Claims, 15 Drawing Sheets

(56) References Cited

U.S. PATENT DOCUMENTS

| | | | | |
|---|---|---|---|---|
| 2010/0181884 | A1* | 7/2010 | De La Garza | F25D 25/024 29/428 |
| 2011/0001415 | A1* | 1/2011 | Park | F25D 25/02 312/408 |
| 2012/0091084 | A1* | 4/2012 | Amaral | F25D 25/024 211/80 |
| 2013/0020922 | A1* | 1/2013 | Jang | F25D 23/067 312/408 |
| 2013/0106274 | A1* | 5/2013 | Yang | F25D 25/02 312/404 |
| 2014/0239792 | A1* | 8/2014 | Chellappan | A47B 96/025 312/408 |
| 2014/0265803 | A1* | 9/2014 | Kelly | F25D 23/00 312/404 |
| 2014/0375199 | A1* | 12/2014 | Lee | F25D 25/024 312/404 |
| 2015/0253064 | A1* | 9/2015 | Kim | F25D 25/024 312/408 |
| 2016/0238307 | A1* | 8/2016 | Lee | F25D 25/02 |
| 2018/0017315 | A1* | 1/2018 | Choi | F25D 23/028 |
| 2018/0274841 | A1* | 9/2018 | Cizik | F25D 25/025 |
| 2019/0120545 | A1 | 4/2019 | Choi et al. | |
| 2019/0195552 | A1* | 6/2019 | Roesch | F25D 25/027 |

FOREIGN PATENT DOCUMENTS

| | | | |
|---|---|---|---|
| DE | 102012205265 | A1 | 10/2013 |
| DE | 102018220657 | A1 | 7/2019 |
| EP | 2184570 | A1 | 5/2010 |
| EP | 2749829 | A2 | 7/2014 |
| GB | 933539 | A | 8/1963 |
| JP | S5885188 | U | 6/1983 |
| WO | 2015007607 | A1 | 1/2015 |

* cited by examiner

SHELF WITH SPECIFIC CENTER WEB FOR SEPARATE PLATE ELEMENTS

CROSS-REFERENCE TO RELATED APPLICATION

This application claims the priority, under 35 U.S.C. § 119, of Turkish Patent Application TR 2019/12527 filed Aug. 21, 2019; the prior application is herewith incorporated by reference in its entirety.

BACKGROUND OF THE INVENTION

Field of the Invention

One aspect of the invention relates to a shelf for a household refrigeration appliance, including a shelf plate which has a first plate element and a separate second plate element which is disposed next to the first plate element in the widthwise direction of the shelf in a use position to form the shelf plate. The second plate element can be removed non-destructively to make the shelf plate smaller. The shelf has a carrier frame which borders the edge of the shelf plate.

Such a shelf is known from International Publication WO 2015/007607 A1. In that case two plate elements are disposed next to one another in the same position in a heightwise direction and a depthwise direction without overlap in the use state, in which items being stored can be positioned on the plate elements. The shelf has just one rear frame element, on which both plate elements are held. A grip element that can be displaced in a widthwise direction is disposed at the front.

A storage rack for refrigerated items is known from International Publication WO 2008/122525 A2, corresponding to U.S. Pat. No. 8,415,416 and U.S. Publication Nos. 2008/0249269; 2011/0230109; and 2012/0184170. The rack has a frame that is closed all round. Two separate plate elements are disposed on the frame. One of the plate elements can be displaced on the frame in a widthwise direction, being pushed over the other plate element. The two plate elements are disposed next to one another in the use state when viewed in the widthwise direction.

A shelf is also known from European Patent Application EP 2 749 829 A2, with which two separate plate elements are disposed one behind the other rather than next to one another. The plate elements are connected by using a pivot apparatus, so that the front plate element can be pivoted up onto the rear plate element.

BRIEF SUMMARY OF THE INVENTION

It is accordingly an object of the invention to provide a shelf with a specific center web for separate plate elements, which overcomes the hereinafore-mentioned disadvantages of the heretofore-known shelves of this general type and with which plate elements that can be positioned next to one another in a widthwise direction are disposed in a more positionally stable manner in relation to one another in a use position.

With the foregoing and other objects in view there is provided, in accordance with the invention, a shelf for a household refrigeration appliance, comprising a shelf plate, which has a first plate element and a separate second plate element, which is disposed next to the first plate element in the widthwise direction of the shelf in a use position to form the continuous shelf plate or storage surface. The second plate element can be removed non-destructively to make the shelf plate smaller. The shelf has a carrier frame, which at least borders parts of the edge of the shelf plate. The shelf has a center web oriented in a depthwise direction of the shelf, on which center web both plate elements rest in their use position or in their use state.

In the use state, items for storage can be positioned or placed on both plate elements. By way of this embodiment, the two plate elements disposed next to one another in the widthwise direction can be stabilized and supported at their interface or at the edge regions facing one another. As a result, in addition to the carrier frame, the center web additionally also can be used as a carrier for both plate elements. Weight forces can be absorbed more effectively. The holding of the plate elements at the same height is also achieved in an improved manner as a result. The shelf can also be referred to as a compartment base.

The center web preferably opens out at a rear frame element of the carrier frame. This creates a holding structure, which in particular also in the rear region supports the plate elements by way of the carrier frame and the center web.

The center web is preferably connected in a releasable manner to the rear frame element at a rear end. In particular, a plug-type connection and/or a screw connection may be configured. As a result, mechanically stable and highly functional connections are achieved. This may also be generated and released in a rapid and simple manner.

In particular, a front end of the center web is cantilevered. It is not connected to any part of the carrier frame in particular.

The center web preferably has an upwardly open bearing platform, on which the second plate element rests in the use position. As a result, the second plate element can be positioned flat in the edge region and yet is not covered at the top. This means that it can be removed from the use position in a rapid and simple manner.

The center web preferably has a receptacle configured adjacent the bearing platform in the widthwise direction, in particular directly following it, with a holding groove. The first plate element projects into the holding groove and is held therein. Since the first plate element is always disposed in the use position, this aforementioned embodiment achieves a secure and stable seating of the first plate element on the center web.

In particular, a lower boundary wall of the holding groove has a snap-fit element. The snap-fit element is snap-fitted into a groove in a lower face of the first plate element. This once more improves the holding of the edge region of the first plate element to the center web. An accurately located and fixed configuration of the first plate element is assisted as a result. Due to the snap-fit connection in the holding groove, a space-saving embodiment is also achieved. An unwanted releasing of the snap-fit connection is prevented.

The center web preferably has a holding groove of a stowage unit of the shelf, into which the second plate element extends in its non-use position, in particular with a side edge oriented in the depthwise direction. The stowage unit is provided to stow the second plate element on the shelf itself, when it is not required or is not required as part of the shelf. In this context, a groove is a simple and space-saving embodiment, in order to be able to store the second plate element securely below the first plate element in the non-use position.

When viewed in the heightwise direction, this holding groove is preferably configured below the receptacle for the first plate element. This means that the stacked state of the plate elements is assisted in the non-use position of the second plate element.

In particular, the two plate elements are disposed congruently one above the other in the non-use position of the second plate element. However, the second plate element is then disposed at a further distance from the first plate element in the heightwise direction. This enables the simple insertion into the stowage unit and the simple removal, because the front edge may be engaged around by a hand of a user.

The holding groove is preferably configured to be upwardly and/or downwardly widened at its front end. In particular, this forms a funnel-shaped inlet. The stowage and removal of the second plate element is made even simpler as a result. This avoids bumping against edges.

In particular, a lower boundary wall of the holding groove is configured to be uneven. This makes it possible to configure different sizes of free space in the holding groove in a heightwise direction. The horizontal positioning of the second plate element is achieved as a result, even if yet another element, such as an edge protection element, is disposed on the plate element for example. Since an edge protection element, in particular with a U-shaped cross section, locally increases the thickness of the composite structure formed of the plate element and the edge protection compared to the plate element alone, it is also possible to hold such an embodiment in the holding groove, without the horizontal positioning of the composite structure being impaired. Only sections of the plate element rest against the lower boundary wall of the holding groove.

The lower boundary wall preferably has a rear, lowered section. As a result, a holding region is formed for the edge protection element at the rear edge of the second plate element.

The center web preferably has a hollow main body and a side cover separate therefrom. The side cover is preferably disposed on the main body such that it can be removed non-destructively. It closes off the side of the main body. This increases the stability of the center web. Furthermore, the inside of the main body is closed off, so that no dust or other particles can enter inside. In particular a snap-fit element is also disposed in a protected manner on the main body, which is configured for a snap-fit connection with the first plate element. In order to release the snap-fit element, the side cover can then be detached and the ability to access the snap-fit element is achieved.

In particular, the center web is shorter than the side frame elements when viewed in the depthwise direction.

The center web may be shorter than half of a side frame element. It may also, however, be larger than the half. The center web may also extend in the depthwise direction up to the front edges of the plate elements. In particular, the center web may extend completely from the front edges up to the rear to a rear frame element of the carrier frame. In particular, the center web extends in parallel with side frame elements. In particular, when viewed in the widthwise direction, the center web is disposed between the side frame elements. In particular, a comb structure or a rake structure is formed by the carrier frame and the center web. When viewed in the depthwise direction, the center web and the side frame elements are forwardly cantilevered webs. They may also be referred to as bar-shaped elements.

The carrier frame is preferably configured as a frame around three sides. In particular, the carrier frame has a rear frame element and two side frame elements. The carrier frame is in particular configured in a U-shaped manner. In particular, the rear frame element and the side frame elements are preferably separate components. They are connected to one another in a releasable manner, in particular by using plug-type connections and by using screw connections. This produces a stable frame concept. The production from individual parts is simpler, since the frame elements can be produced more simply.

An upper grooved holder is preferably configured in the rear frame element, into which upper grooved holder a rear edge of the first plate element is inserted. In particular, a side frame element has an upwardly open bearing platform, on which the first plate element rests. This allows a secure and fixed seating of the first frame element.

The rear frame element and/or a side frame element and the center web preferably include a stowage unit of the shelf. With the stowage unit, the second plate element can be stowed on the shelf itself when it is not required. The second plate element is then stowed below the first plate element on the shelf in its non-use position.

The rear frame element preferably has an integrated holding groove for the stowage unit and/or the side frame element has an integrated holding groove for the stowage unit, and the center web has a holding groove for the stowage unit. In particular, this relates to a first side frame element. A second, opposing side frame element in particular does not have such a holding groove. This is because the second plate element is not positioned in the non-use position. In this example, the stowage unit is formed from a number of holding grooves. This achieves a concept which is space-saving and yet functional in relation to the secure positioning. In particular, the stowage unit is formed from three holding grooves. These are disposed to form a U-shaped overall groove, so that, in the non-use position, the second plate element is positioned at a rear edge and at opposing side edges therein.

The terms "top," "bottom," "front," "rear," "horizontal," "vertical," "depthwise direction," "widthwise direction," "heightwise direction," etc. refer to the positions and orientations resulting when the shelf is used and disposed in the correct manner.

Further features of the invention will emerge from the claims, figures and description of the figures. The features and feature combinations cited above in the description as well as the features and feature combinations cited in the following in the description of the figures and/or shown in the figures alone can be used not only in the respectively cited combination but also in other combinations, without departing from the scope of the invention. Therefore, embodiments of the invention which are not specifically described and illustrated in the figures but will emerge and can be generated from the described embodiments as a result of separate feature combinations are also deemed to be covered and disclosed by the invention. Embodiments and feature combinations which do not therefore have all of the features of an originally formulated independent claim should also be deemed to be disclosed. Embodiments and feature combinations, which go beyond or deviate from the feature combinations set out in the claims, should also be deemed to be disclosed, in particular as a result of the embodiments set out above.

Other features which are considered as characteristic for the invention are set forth in the appended claims.

Although the invention is illustrated and described herein as embodied in a shelf with a specific center web for separate plate elements, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
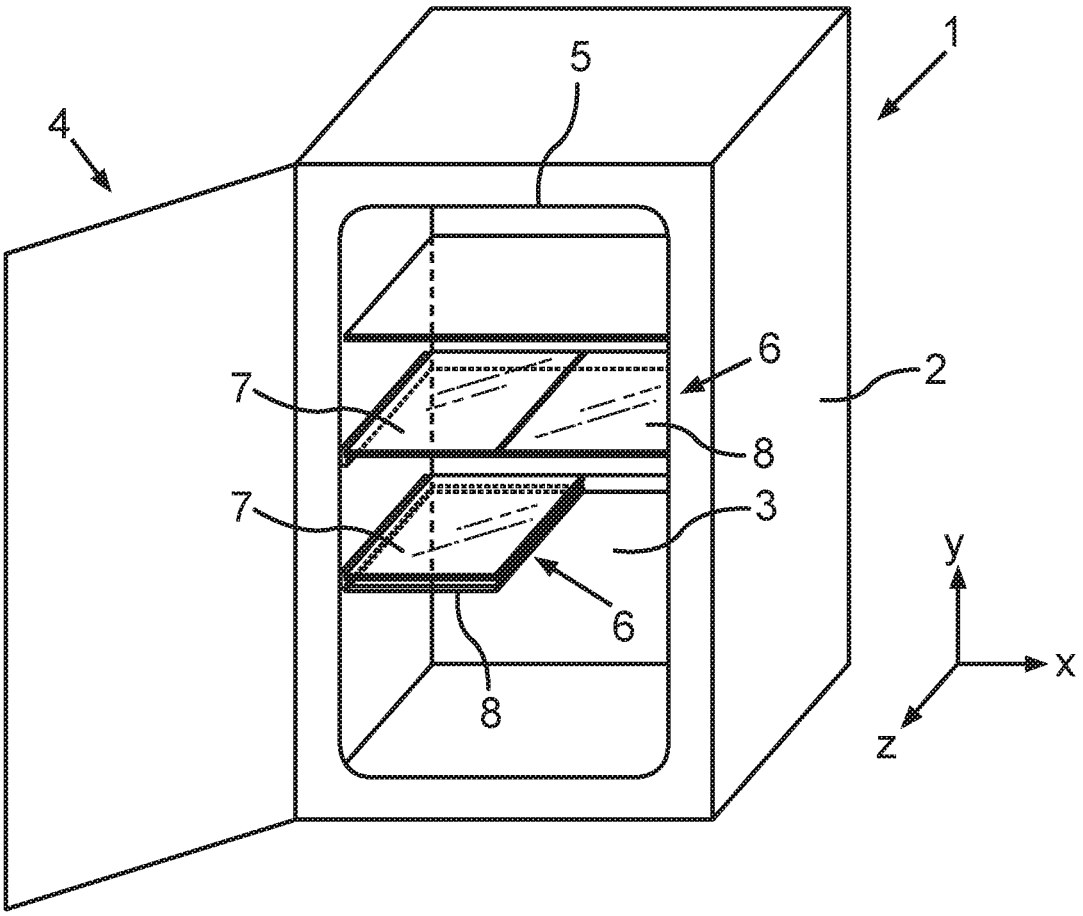
FIG. 1 is a diagrammatic, perspective view of an exemplary embodiment of an inventive household refrigeration appliance.

Referring now in detail to the figures of the drawings, in which identical elements or those of identical function are shown with the same reference characters and first, particularly, to FIG. 1 thereof, there is seen a perspective view of a household refrigeration appliance 1. The household refrigeration appliance 1 is configured to store and preserve food. The household refrigeration appliance 1 has a housing 2. At least one compartment 3 for holding food is configured in the housing 2. The compartment 3 can be a refrigeration compartment or a freezer compartment.

The household refrigeration appliance 1 can be a refrigerator or a freezer or a combined refrigerator/freezer appliance. The household refrigeration appliance 1 also has a door 4. The door 4 is disposed pivotably on the housing 2. It is disposed so that it closes the front of the compartment 3. The compartment 3 is delimited by walls of an inner container 5 of the household refrigeration appliance 1. In the example shelves are disposed in the compartment 3. The removable shelves can also be referred to as compartment bases. An exemplary embodiment of a shelf 6 is shown to illustrate this. In this exemplary embodiment a shelf plate is formed as a continuous surface from two separate plate elements 7, 8. Both plate elements are disposed in the use position. They are disposed next to one another in this case in the widthwise direction (x-direction) of the shelf 6. The widthwise direction is also that of the household refrigeration appliance 1. The two plate elements are disposed at the same height in a heightwise direction (y-direction). The heightwise direction corresponds to that of the shelf 6 and is also the same as the heightwise direction of the household refrigeration appliance 1. In their use position the two plate elements 7, 8 are also disposed at the same depth as one another in a depthwise direction (z-direction). The depthwise direction of the shelf 6 also corresponds to the depthwise direction of the household refrigeration appliance 1.

FIG. 1 also shows a corresponding shelf 6 by way of example, with only the use position of the first plate element 7 being shown. The second plate element 8 is disposed below the first plate element 7 in a heightwise direction and is positioned in a non-use position. However, it remains disposed or stowed on the shelf 6 itself in this non-use position.

Figure 2:
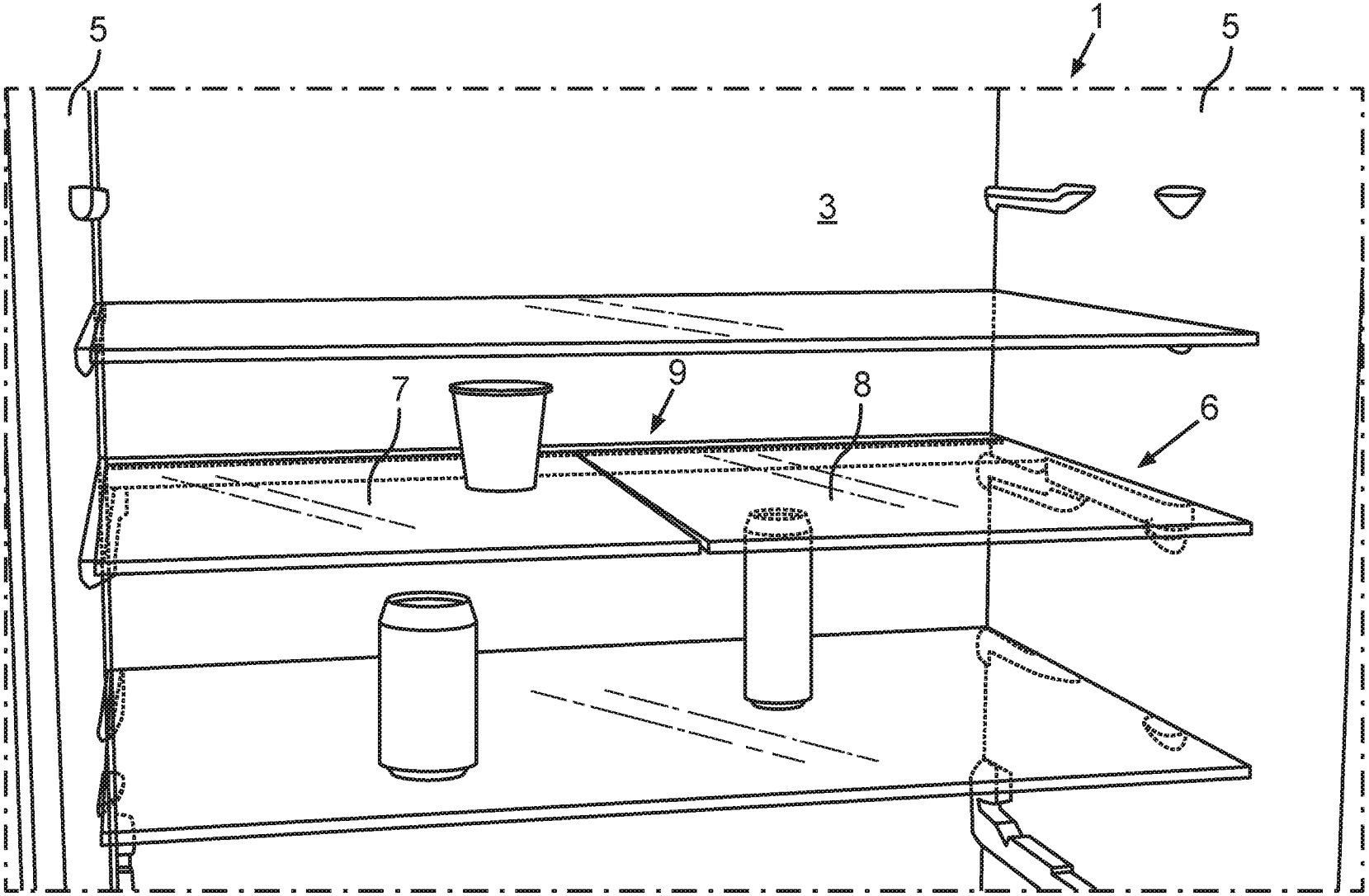
FIG. 2 is a fragmentary, enlarged perspective view of an exemplary embodiment of an inventive shelf in a compartment of the household refrigeration appliance, the shelf being shown with both plate elements of a shelf plate in a use position.

FIG. 2 shows an enlarged view of a detail of the household refrigeration appliance 1. A number of compartment bases or shelves 6 are also disposed in this case by way of example. A shelf 6 is shown herein with two plate elements 7 and 8 in a use position. The first plate element 7 and the second plate element 8 are disposed next to one another and without overlap so that they form a common continuous horizontal and flat shelf plate 9. As shown, objects, in particular items for storage, can be placed on the shelves 6. When the entire shelf plate 9 is in the full use position according to the view in FIG. 2, objects can be placed on both plate elements 7 and 8.

Figure 3:
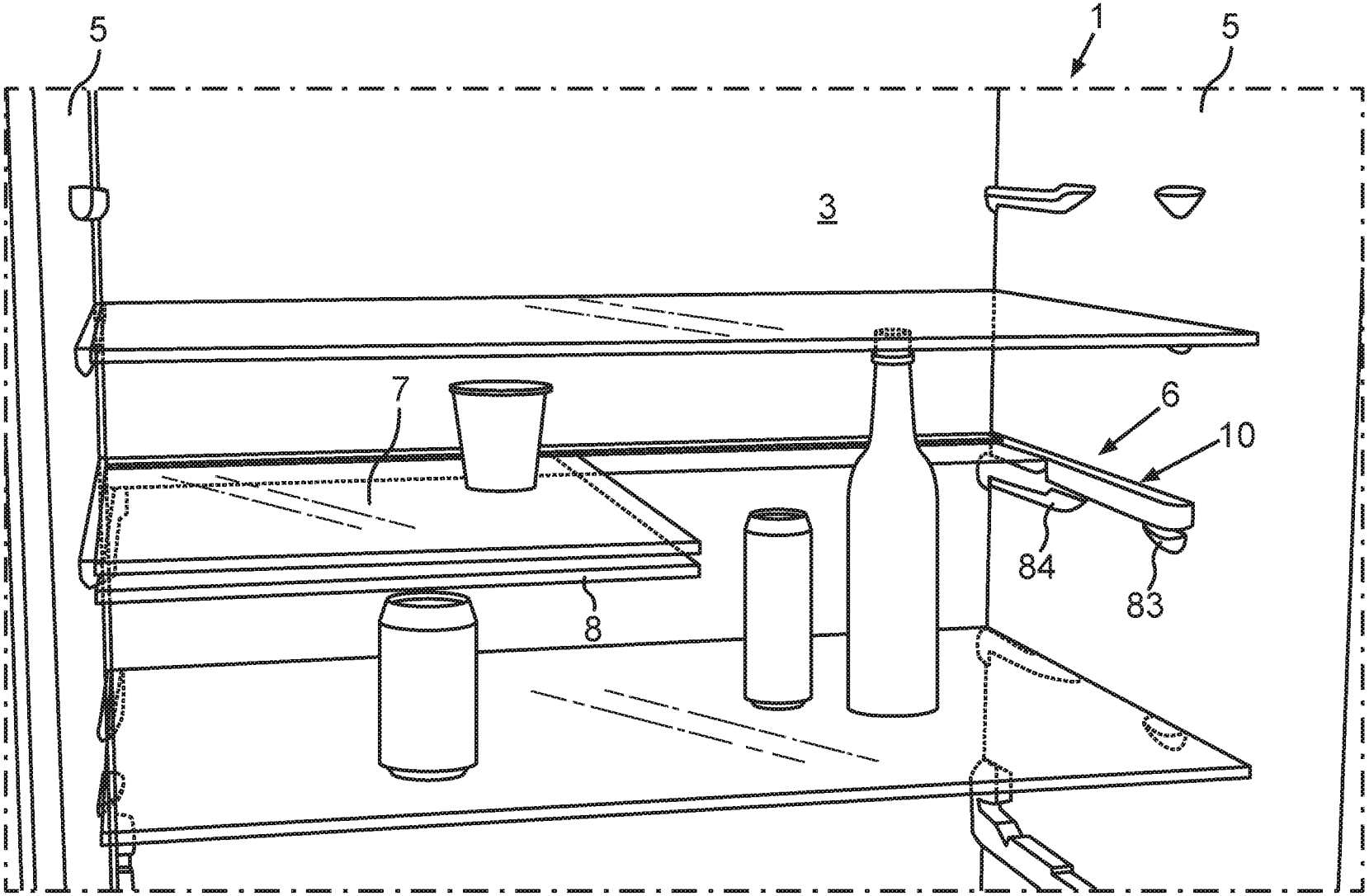
FIG. 3 is a view similar to FIG. 2, in which the second plate element is disposed in a non-use position.

FIG. 3 shows the shelf 6 in a configuration, in which only the first plate element 7 is disposed in the use position. The second plate element 8 is disposed in the non-use position. To this end it is disposed below the first plate element 7 when viewed in a heightwise direction and in the same width position as the first plate element 7 when viewed in the widthwise direction and/or at the same depth position as the first plate element 7 when viewed in a depthwise direction. In particular the second plate element 8 is stowed on a carrier frame 10 of the shelf 6 in the non-use position. In this embodiment the space that becomes free in an upward direction in the region of the second plate element 8 can be used to hold larger objects, such as bottles, below the shelf 6, these then projecting further up in a heightwise direction than the shelf 6. Those objects then extend upward between the two stacked plate elements 7 and 8 and the carrier frame 10.

Figure 4:
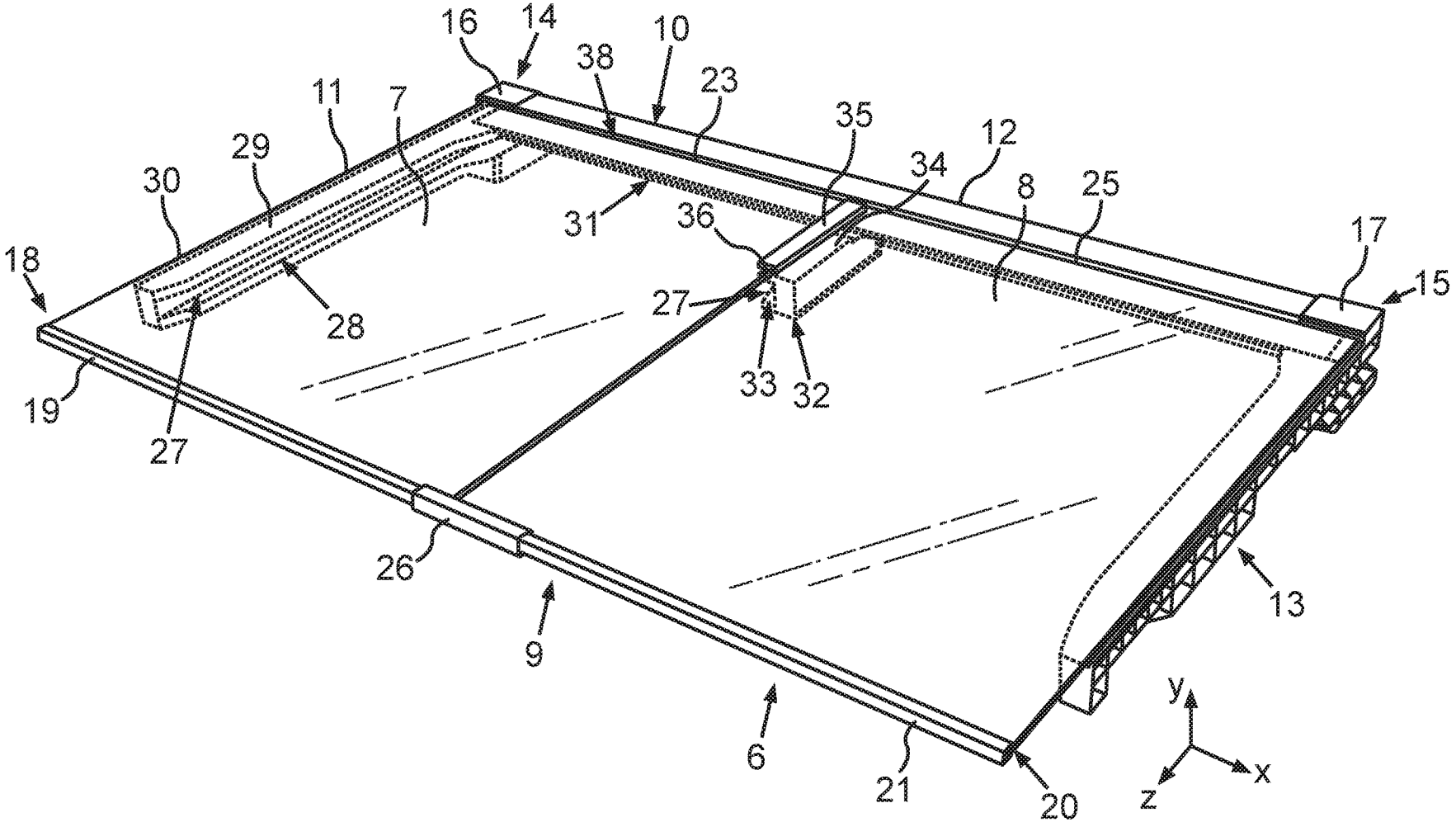
FIG. 4 is a perspective view of an exemplary embodiment of an inventive shelf with the shelf plate in the use position.

FIG. 4 shows a perspective view of an exemplary embodiment of a shelf 6. The shelf 6 includes the first plate element 7 and the separate second plate element 8. The first plate element 7 is a preferably rectangular plate. The second plate element 8 is preferably a rectangular plate. In particular the two plate elements 7 and 8 are identical in size. The first plate element 7 and/or the second plate element 8 can be made of an at least partially transparent material. They can be plastic or glass plates.

In particular the shelf 6 has a carrier frame 10 that is separate from the two separate plate elements 7 and 8. The carrier frame 10 is U-shaped. It only engages around the shelf plate 9 on three sides. The carrier frame 10 is therefore only a three-sided frame. As shown in the view in FIG. 4, the carrier frame 10 has a first side frame element 11, a rear frame element 12 and a second side frame element 13. The shelf plate 9 is not bordered by the carrier frame 10 at least at the front. The shelf plate 9 is exposed at the front.

Provision can be made for the three-sided carrier frame 10 to be configured as a single piece. This means that it is also produced as a single piece.

In one advantageous embodiment, provision is made for the three frame elements 11, 12 and 13 to be separate components. They can be connected to one another by using a respective connection, in particular a non-destructively releasable connection. Provision can be made in particular for the first frame element 11 to be connected to an end of the rear frame element 12 at its rear end in the depthwise direction (z-direction). In particular a plug-type connection and/or a screw connection can be provided in this case. The same provision can be made in a rear corner region of the shelf 6 between the second side frame element 13 and the rear frame element 12.

In one advantageous embodiment, provision is made for the rear frame element 12 to be inserted into the first side frame element 11. The same provision can be made for the connection between the rear frame element 12 and the second side frame element 13. This results in connections that overlap in a widthwise direction between the above-mentioned frame elements 11, 12, 13 in rear corner regions 14 and 15. Provision is made in particular for an end plate 16 of the first frame element 11, which is only disposed in the corner region 14, to partially cover the rear frame element 12 from above. The same provision can be made with a cover plate 17 between the second side frame element 13 and the rear frame element 12. The cover plate 17 is only configured in the corner region 15.

FIG. 4 shows the shelf plate 9 in a full use position. This means that both plate elements 7 and 8 are disposed next to one another in a widthwise direction, in particular without overlap. They are in identical positions in a depthwise direction and in a heightwise direction, forming a continuous rectangular shelf plate 9. In particular the shelf 6 is also configured in a rectangular manner.

In one advantageous embodiment, provision is made for the first plate element 7 to have a separate edge protection element 19 on a front edge 18. This is configured in particular as a U-profile and/or as a single piece. Provision can also be made for a corresponding edge protection element 21 to be disposed on a front edge 20 of the second plate element 8.

The edge protection elements 19 and 21 can be rails that are separate from the plate elements 7 and 8. They are for example attached or bonded thereto.

Figure 5:
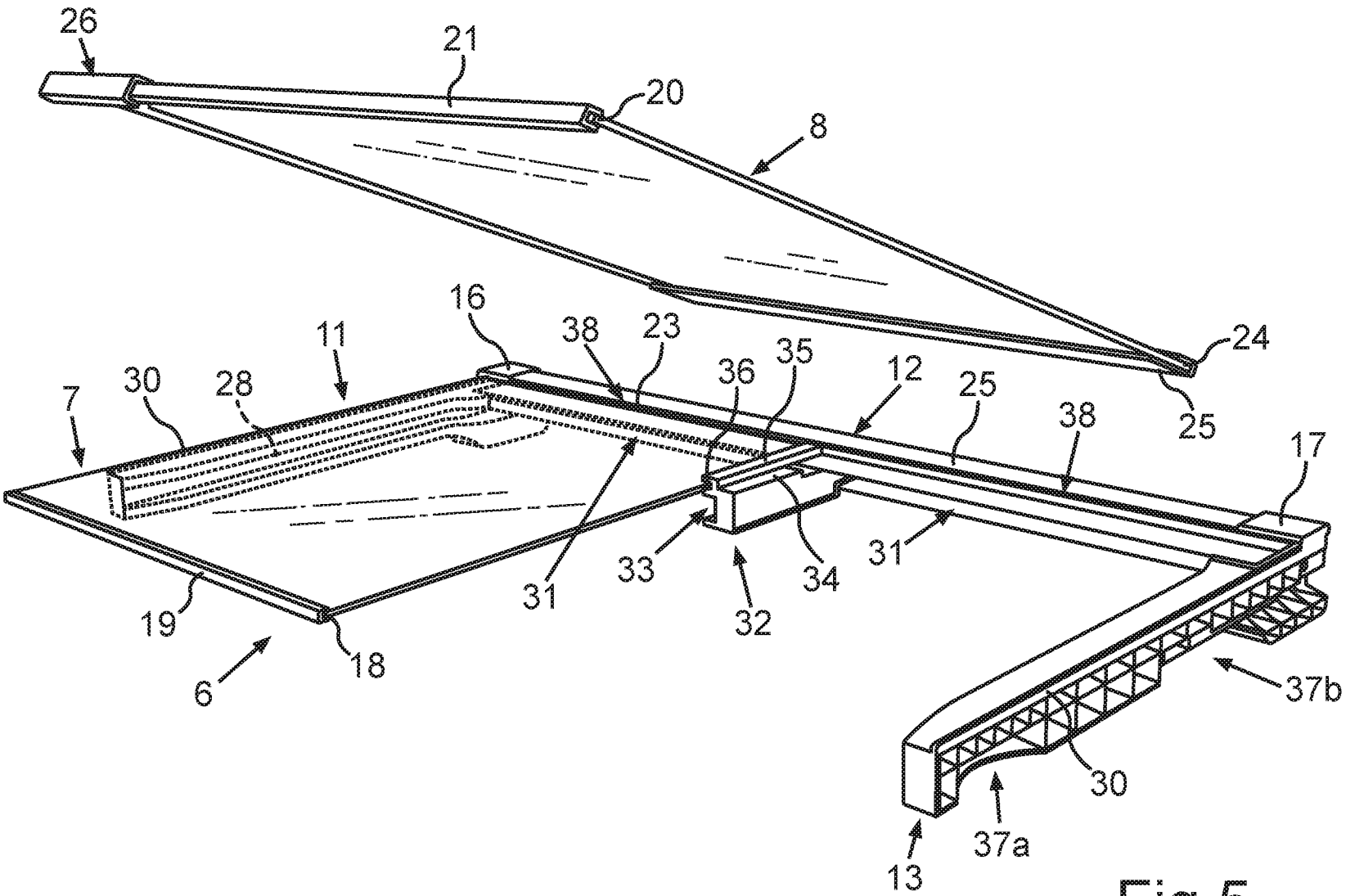
FIG. 5 is a view similar to FIG. 4, in which the second plate element has been removed from the use position.
Figure 7A:
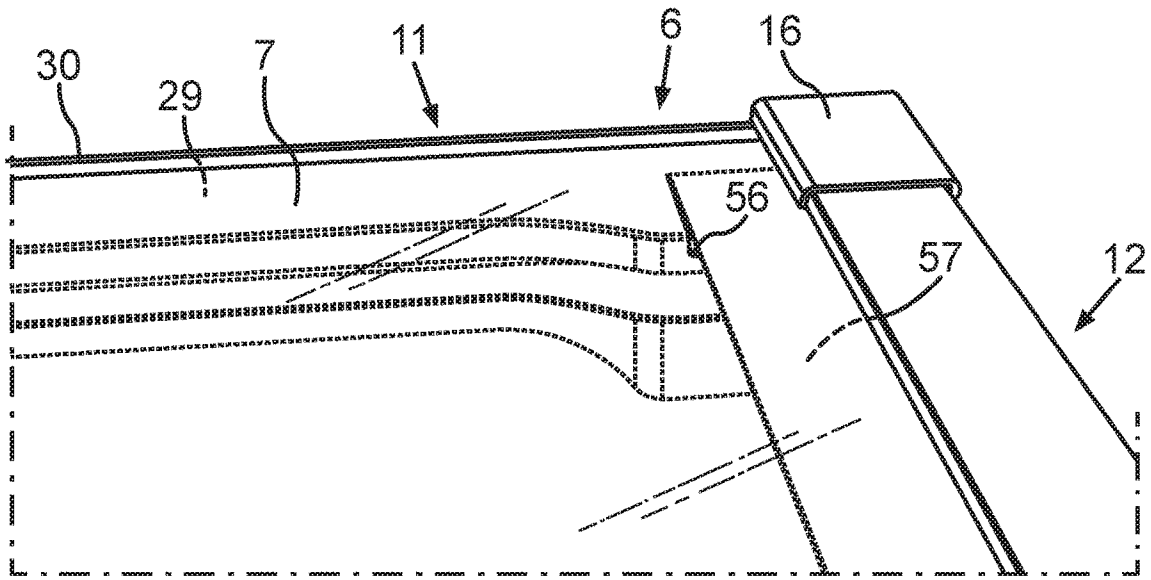
FIG. 7A is a fragmentary, perspective view of a rear corner region of the shelf in the region of the first plate element of the shelf plate.
Figure 7B:
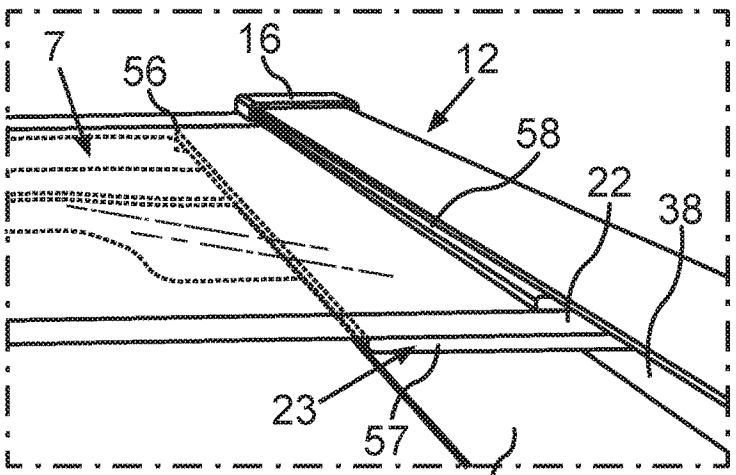
FIG. 7B is a different fragmentary, perspective view of the components according to FIG. 7A.

In one advantageous embodiment, provision is made for the first plate element 7 to have a separate edge protection element 23 on its rear edge 22 opposite the front edge 18 (FIG. 7B). The edge protection element 23 can be U-shaped in particular in cross section in this case too. Provision can also be made in particular for the second plate element 8 to have a separate edge protection element 25 at its rear end 24 (FIG. 5). The edge protection element 25 can be U-shaped.

In one advantageous embodiment, the shelf 6 also has a connecting element or a front securing element 26 that is separate from the plate elements 7, 8 and the carrier frame 10. The securing element 26 is configured as a rail or bar. It engages around the front of the second plate element 8. In particular it is disposed on the second plate element 8 in such a manner that it cannot be displaced in a widthwise direction. In particular it is disposed in a fixed position thereon. For example, a clamped connection or bonded connection or the like can be provided in this case. In particular the securing element 26 also engages around the edge protection element 21.

The securing element 26 projects laterally in a widthwise direction beyond the width of the second plate element 8 in its corner region. When the entire shelf plate 9 is in the use position shown in FIG. 4, the securing element 26 therefore also protrudes beyond a sub-region of the front edge 18 of the first plate element 7. In particular it also engages around a preferably present front edge protection 19 at the front. The securing element 26 is however not connected to the second plate element 7 in a fixed manner. It only serves as a front protective cover or protective cap for the first plate element 7. In particular there is no position-securing connection to the first plate element 7 in a widthwise direction and in a depthwise direction. The fixed configuration of the securing element 26 on the second plate element 8, which results in a position-fixing configuration thereon in a depthwise direction, means that the same is not brought about with the first plate element 7. The fixed positioning in a depthwise direction on the second plate element 8 means that the first plate element 7 is also held at the same level in a heightwise direction as the second plate element 8 in this configuration according to FIG. 4. When the shelf plate 9 is in the full use position the securing element 26 therefore represents a front position or level holding element. This prevents unwanted displacement of the two plate elements 7 and 8 in a heightwise direction.

As is shown in FIG. 4, the two side frame elements 11 and 13 do not extend over the entire depth of the plate elements 7 and 8. They end a distance before the front edges 18 and 20.

In one advantageous embodiment, provision is made for the shelf 6 to have a stowage unit 27. The stowage unit 27 is integrated in particular in the first side frame element 11 and/or the rear frame element 12 and is therefore configured as a single piece therewith. In particular the stowage unit 27 has a holding groove 28 in the first side frame element 11. The side of the first plate element 7 is held by the first side frame element 11. The second plate element 8 is not held by it in the use position.

The holding groove 28 is configured below a bearing platform 29 of the first frame element 11 when viewed in a heightwise direction. The bearing platform 29 is open at the top. This allows the first plate element 7 to be positioned thereon from above. It is not covered laterally by the first frame element 11 in an upward direction.

The first frame element 11 also has a side stop web 30. The stop web 30 rises upward from the bearing platform 29.

The stop web 30 forms a position limit or displacement stop for the first plate element 7 in a widthwise direction.

In one advantageous embodiment, the stowage unit 27 also has a further holding groove 31 in the rear frame element 12. The holding groove 31 shown in FIG. 5 is open at the front. The second plate element 8 can therefore be inserted into the holding groove 28 and/or the holding groove 31 in the use position and is therefore stowed below the first plate element 7.

The shelf 6 has a center web 32 (FIG. 4). The center web 32 is preferably a part that is separate in particular from the carrier frame 10. The center web 32 holds the first plate element 7 on the edge region opposite the first frame element 11. The center web 32 extends in a depthwise direction. In one advantageous embodiment it is disposed directly on the rear frame element 12. The center web 32 can be a separate part from the rear frame element 12. It can be connected to the rear frame element 12 by a plug-type connection and/or a screw connection. Provision can be made for the center web 32 to be shorter, when viewed in a depthwise direction, than the two side frame elements 11 and 13. Provision can also be made for the center web 32 to be longer. The center web 32 can extend over the entire length of the two plate elements 7 and 8 measured in a depthwise direction. The center web 32 is formed as a mount or bearing part for the first plate element 7. When the second plate element 8 is in the use position, it is also disposed so that it rests on the center web 32. When the second plate element 8 is in the non-use position, in one advantageous embodiment, the center web 32 also serves as a subcomponent of the stowage unit 27. To this end the center web 32 advantageously has an integrated holding groove 33. The second plate element 8 can be inserted into this and held therein in the non-use position.

In one advantageous embodiment, provision can therefore be made for the stowage unit 27 to be formed by a three-sided, in particular U-shaped, holding groove. This can be formed by the three separate holding grooves 28, 31 and 33.

As is shown in FIG. 4, the center web 32 has a bearing platform 34. The bearing platform 34 is configured to be open at the top. Only the second plate element 8 rests on top of the bearing platform 34 in its use position. The center web 32 also has an integrated retaining part 35. This preferably has a slot or groove 36. The edge of the first plate element 7 projects into the slot or groove 36. This is shown in FIG. 4. As is shown, the engagement part 35 with the groove 36 is disposed above the preferably configured holding groove 33 when viewed in a heightwise direction.

The first plate element 7 is in particular incorporated in a fixed position on the carrier frame 10 and the center web 32.

FIG. 5 shows a perspective view of the shelf 6, with the second plate element 8 removed from its use position. In FIG. 5 the second side frame element 13 is shown in a sectional view (sectional plane is the y-z plane). As shown in the views in FIG. 4 and FIG. 5, the second frame element 13 has a cutout 37*a* that is open at the bottom. A holding cam, for example a cam 83, 84 (FIG. 18), disposed on a side wall of the inner container 5, can be disposed in this cutout 37*a*. Additionally or alternatively a further cutout 37*b* can be configured, into which a further cam, for example cam 83 or 84 (FIG. 18), can engage on a vertical side wall of the inner container 5. This is the case when the shelf 6 is disposed in the compartment 3 and held in particular on vertical side walls of the inner container 5. The first frame element 11 can also be configured in the same way.

In particular the holding groove 31 referred to above is configured in the rear frame element 12 preferably at least over the length of the first plate element 7. It can be configured over the entire length of the rear frame element 12. This is shown in FIG. 5. As shown in the views in FIG. 4 and FIG. 5, the insides of the two side frame elements 11 and 13 are configured as a framework structure. This means that they are low in weight and also extremely rigid.

Provision is made in particular for the second side frame element 13 not to have a component for the stowage unit 27. In particular it therefore has no additional holding groove, as formed by the holding groove 28.

A grooved holder 38, as shown in FIG. 4 and FIG. 5, is preferably configured to hold the first plate element 7 on the rear frame element 12. In one advantageous embodiment the grooved holder 38 is configured over the entire length of the rear frame element 12 in the widthwise direction. It therefore also serves correspondingly to hold the rear region of the second plate element 8, when the latter is disposed in the use position. The grooved holder 38 is configured above the separate holding groove 31 in a heightwise direction.

Figure 6:
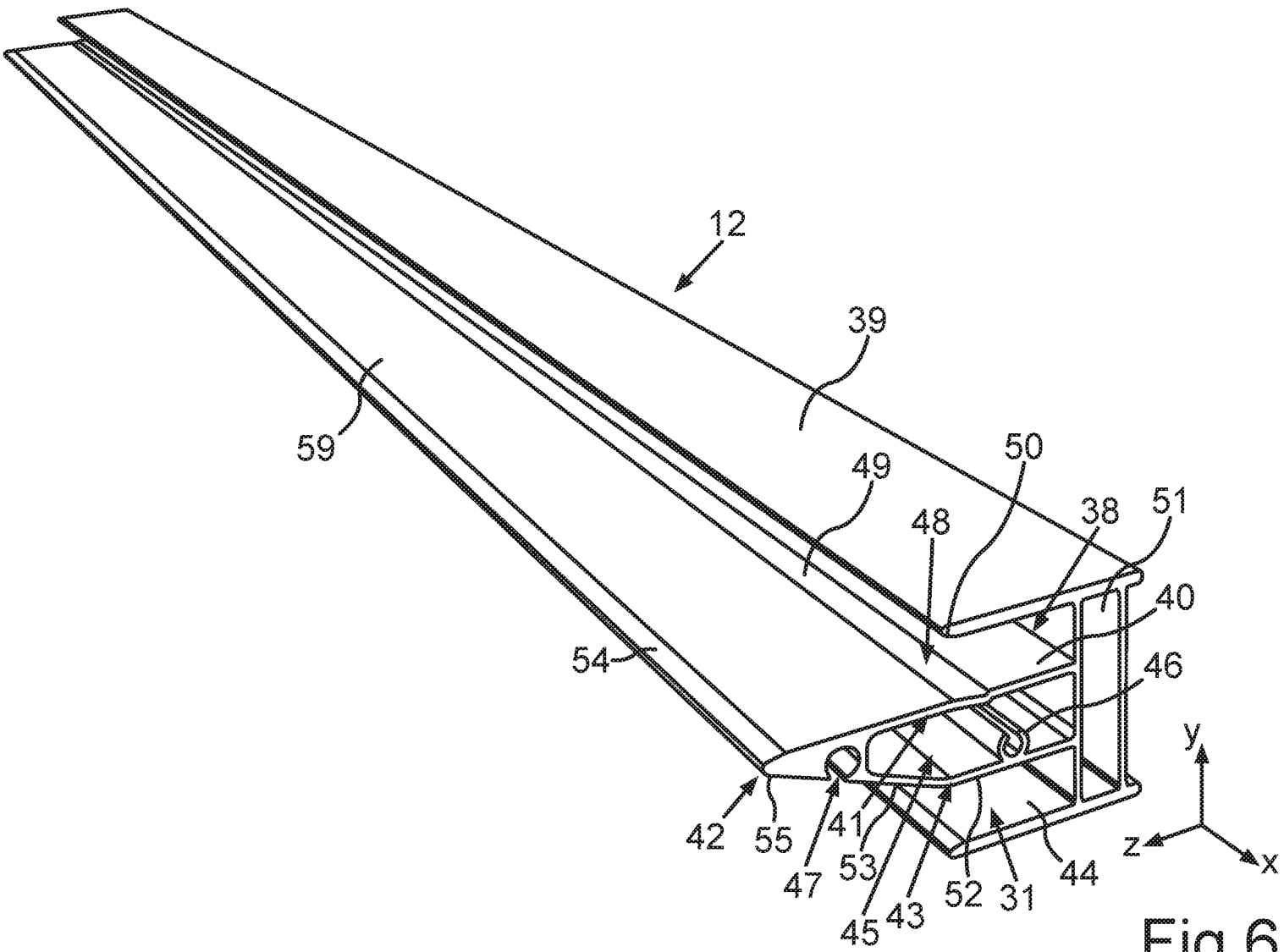
FIG. 6 is a perspective view of an exemplary embodiment of a rear frame element of a carrier frame of the shelf.

FIG. 6 shows a perspective view of the rear frame element 12. As shown, the grooved holder 38 is delimited by an upper wall 39. The grooved holder 38 is delimited by a boundary wall 40 at the bottom. The boundary wall 40 is an upper wall 41 of a separating web 42. The separating web 42 is configured as a single piece with the rear frame element 12. The separating web 42 includes the upper wall 41. It also includes a lower wall 43. The separating web 42 is preferably configured as a hollow profile. The lower wall 43 of the separating web 42 delimits the holding groove 31 at the top. The separating web 42 is therefore a partition between the grooved holder 38 and the holding groove 31 and delimits both directly. The holding groove 31 is delimited at the bottom by a lower wall or lower boundary wall 44. As shown, the separating web 42 extends further forward, when viewed in a depthwise direction, than the upper boundary wall or the upper wall 39. It therefore also extends further forward than the lower boundary wall 44.

As is shown in FIG. 6, at least one screw dome 46 is integrated in a hollow space 45 in the separating web 42. In the view in FIG. 6 the second side frame element 13 can be screwed to the screw dome 46. The side of the second frame element 13 is also positioned on the structure of the rear frame element 12. A further drilled hole 47 is also integrated in a front, in particular tapered, region of the separating web 42. The drilled hole 47 is preferably configured to pass through the entire length. The separate center web 32 can be screwed to it. This also allows additional screwing of the side frame element 13 to the end of the rear frame element 12.

As is also shown in FIG. 6, the upper wall 41 of the separating web 42 also has a surface offset 48. This channel-like offset 48, which is oriented in the direction of the longitudinal axis and is configured in a depthwise direction by configuring a height offset, in particular a stepped height offset, allows easier removal of the second plate element 8. In particular the surface offset 48 has an angled wall 49 oriented downward. The upper wall 39 advantageously has a bevel 50 facing the grooved holder 38 at its front end. This widens the grooved holder 38 at its front end, thereby facilitating the insertion and removal of the second plate element 8.

Provision is made in particular for the rear frame element 12 to have a hollow chamber 51, which adjoins the grooved holder 38 and the holding groove 31 as well as the separating web 42 at the rear.

As is also shown in FIG. 6, the lower wall 43 of the separating web 42 is in particular not configured to be straight. It has a straight rear segment 52. Adjoining this at the front is a further segment 53 oriented at an angle upward and to the front. The bevel on one hand allows better securing of the position of the side frame element 13 and/or 11 and/or better securing of the position of the center web 32. In particular it allows easier removal and insertion of the second plate element 8 into the stowage position below the first plate element 7.

In one advantageous embodiment, provision is also made for the separating web 42 to have both an upward bevel 54 and a downward bevel 55 in its front edge region. Such tapering in the taper also facilitates the insertion and removal of the plate elements 7 and/or 8.

FIG. 7A shows a perspective view of a left rear corner region of the shelf 6. As shown, the bearing platform 29 has a holding trough 56. A lower arm 57 of the edge protection element 23 is embedded herein. As is also shown, the position of the first plate element 7 is also secured in a depthwise direction by the end plate 16. The end plate 16 engages forward around an upper arm 58 of the edge protection element 23. As is also shown in FIG. 7B, the lower arm 57 of the edge protection element 23 extends further forward than the upper arm 58.

As is shown in FIG. 7B, the separating web 42 includes a bearing platform 59 in its upper wall 41. The lower arm 57 rests on this bearing platform 59. This allows better positioning and a mechanically more stable configuration of the first plate element 7.

The same applies to the second plate element 8, when it is disposed in the use position on the rear frame element 12.

Provision can also be made for the bearing platform 59 to serve as a storage region for items, in particular stored goods. This is possible particularly when the second plate element 8 is disposed in its non-use position, thereby exposing the top of the bearing platform 29 at least over the width of the second plate element 8 when viewed in a widthwise direction. Smaller items, such as yogurt containers or the like, can be placed thereon in this case for example.

Figure 8B:
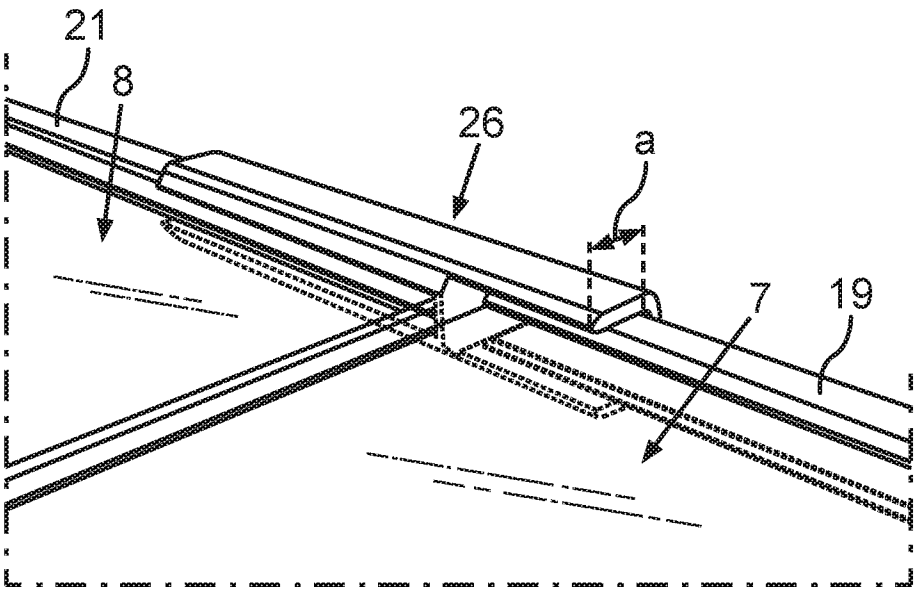
FIG. 8B is a view similar to FIG. 8A, also showing the first plate element of the shelf plate.
Figure 8A:
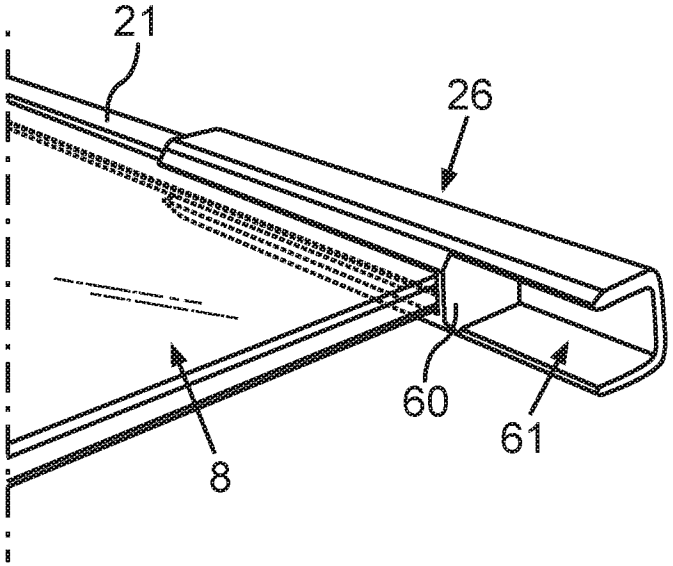
FIG. 8A is a fragmentary, perspective view of the second plate element in the front region with a separate securing element disposed thereon.

FIG. 8A shows a partial detail of the front region of the second plate element 8. The clamping position, in particular secured against displacement in a widthwise direction, of the securing element 26 is clearly shown. In particular the securing element 26 is configured in the manner of a brace and engages around the edge protection element 19. This prevents removal in a depthwise direction. Displacement in a widthwise direction is also prevented by a stop wall 60. As shown in the view in FIG. 8*b*, the securing element 26 has a hollow region 61. The hollow region 61 engages around the front corner region of the first plate element 7, as shown in FIG. 8B. This is the case when both plate elements 7 and 8 are disposed in the use position. As is also shown in FIG. 8B, an overlap a measured in a depthwise direction is configured between the securing element 26 and the first plate element 7. It can also be seen that there is no clamping in the longitudinal segment of the securing element 26, which is only configured to hold the front corner regions of the first plate element 7. The front corner region of the first plate element 7 therefore simply projects into the hollow region 61, without a clamping or snap-in connection being configured.

Figure 9:
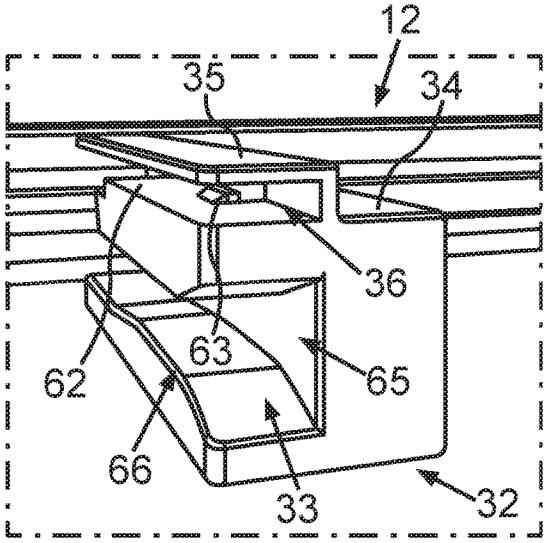
FIG. 9 is a fragmentary, perspective view of a center web, which is disposed between the two plate elements of the shelf plate.
Figure 11:
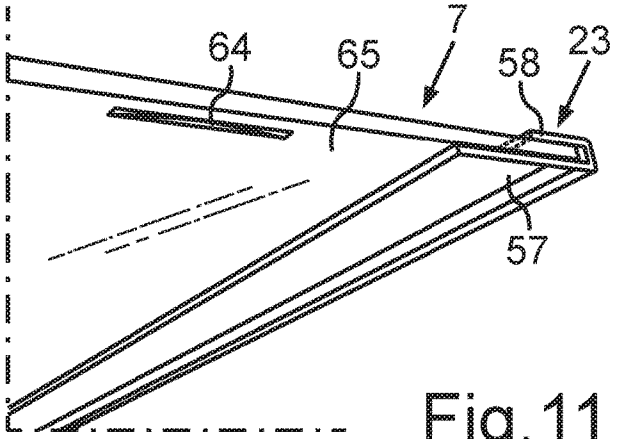
FIG. 11 is a fragmentary, perspective view of a sub-region of the first plate element.

FIG. 9 shows a further perspective view of the center web 32. As is shown, a snap-fit element 63 is configured on a base 62 of the groove 36. It projects into the groove 36. This allows a snap-fit connection with a snap-fit holder 64, as shown in FIG. 11. The snap-fit holder 64 is configured in a lower face 65 of the first plate element 7. This improves the secured configuration and mounting in a fixed position of the first plate element 7 in particular on the center web 32. The snap-fit holder 64 can be for example a groove ground in the lower face 65.

FIG. 9 also shows the holding groove 33. A front groove opening of the holding groove 33 is widened at the top and bottom. It can also be seen that a lower boundary wall 66 of the holding groove 33 is uneven.

Figure 10:
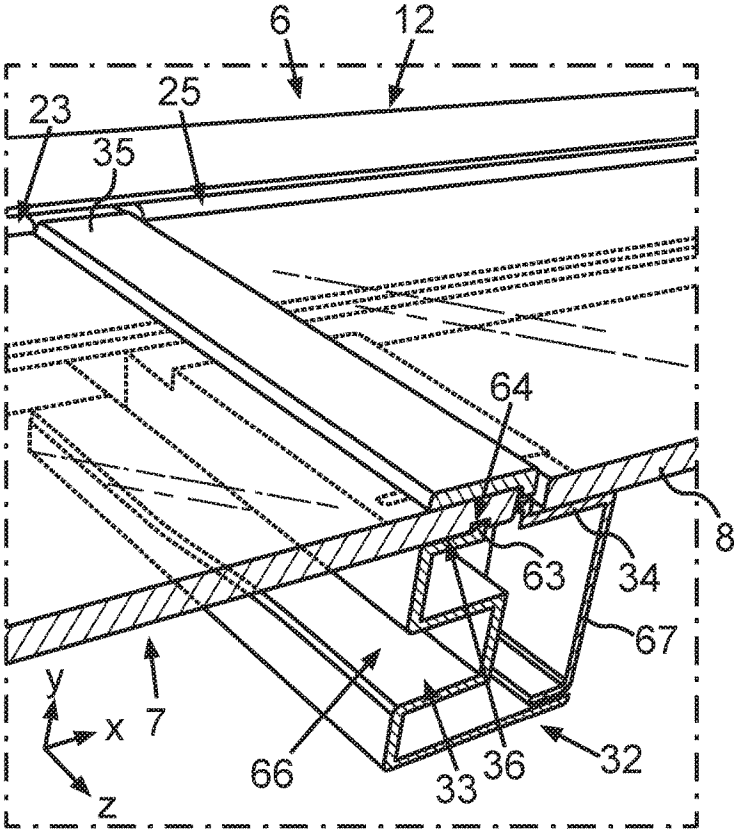
FIG. 10 is a vertical, perspective sectional view through the center web according to FIG. 9, also showing the two plate elements of the shelf plate.

FIG. 10 shows a vertical sectional view (sectional plane is the y-x plane) of the shelf 6 in the region of the center web 32 and through the snap-fit element 63. It can be seen that the center web 32 is hollow inside. In one advantageous embodiment the center web 32 can have a side cover 67 that closes off the side of the hollow region.

Figure 12:
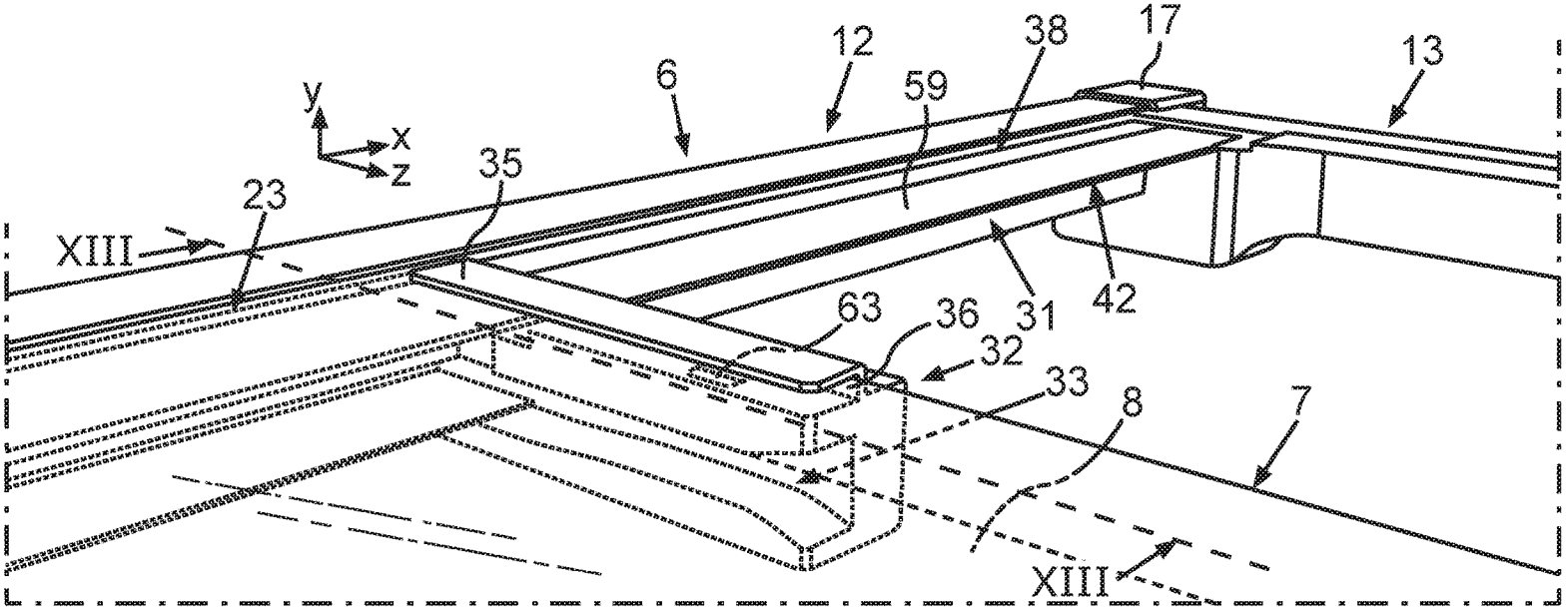
FIG. 12 is a fragmentary, perspective view of a further sub-region of the shelf.

FIG. 12 shows a perspective view of a sub-region of the shelf 6. It shows the stowage position or non-use position of the second plate element 8 below the first plate element 7.

Figure 13:
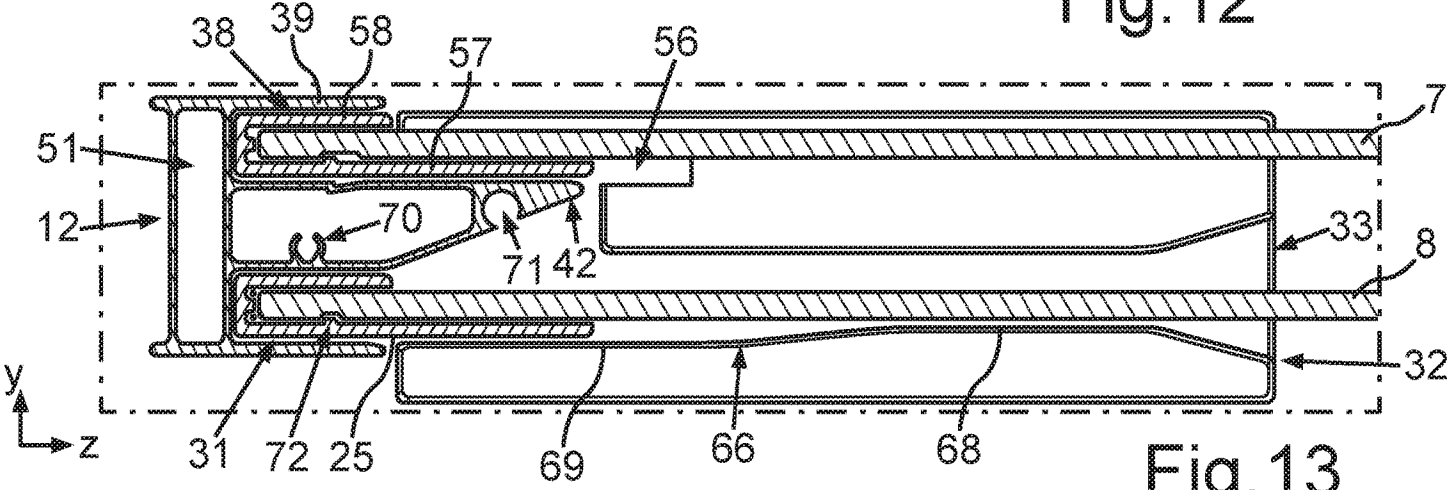
FIG. 13 is a fragmentary, vertical sectional view through the diagram according to FIG. 12.

FIG. 13 shows a vertical sectional view (sectional plane is the y-z plane) along a section line XIII-XIII in FIG. 12. The center web 32 is shown herein in the uncut state. It can be seen from this view that the edge of the second plate element 8 is inserted into the holding groove 33. The non-flat embodiment of the lower boundary wall 66 means there is a base rise 68, on which the lower face of the second plate element 8 rests directly. A lowered region 69 of the lower boundary wall 66 is configured to the rear when viewed in a depthwise direction. This forms an air space for the edge protection element 25 when viewed in a heightwise direction. The second plate element 8 can therefore be supported flat in the holding groove 33. Further possible screw domes 70 and 71 are shown therein. It can also be seen that a further snap-fit element 72 is configured on the edge protection element 25. This projects into a snap-fit holder 73 on the lower face of the plate element 8. This snaps the edge protection element 25 onto the second plate element 8. The same provision can be made with the edge protection element 23 to snap it onto the first plate element 7.

Figure 14:
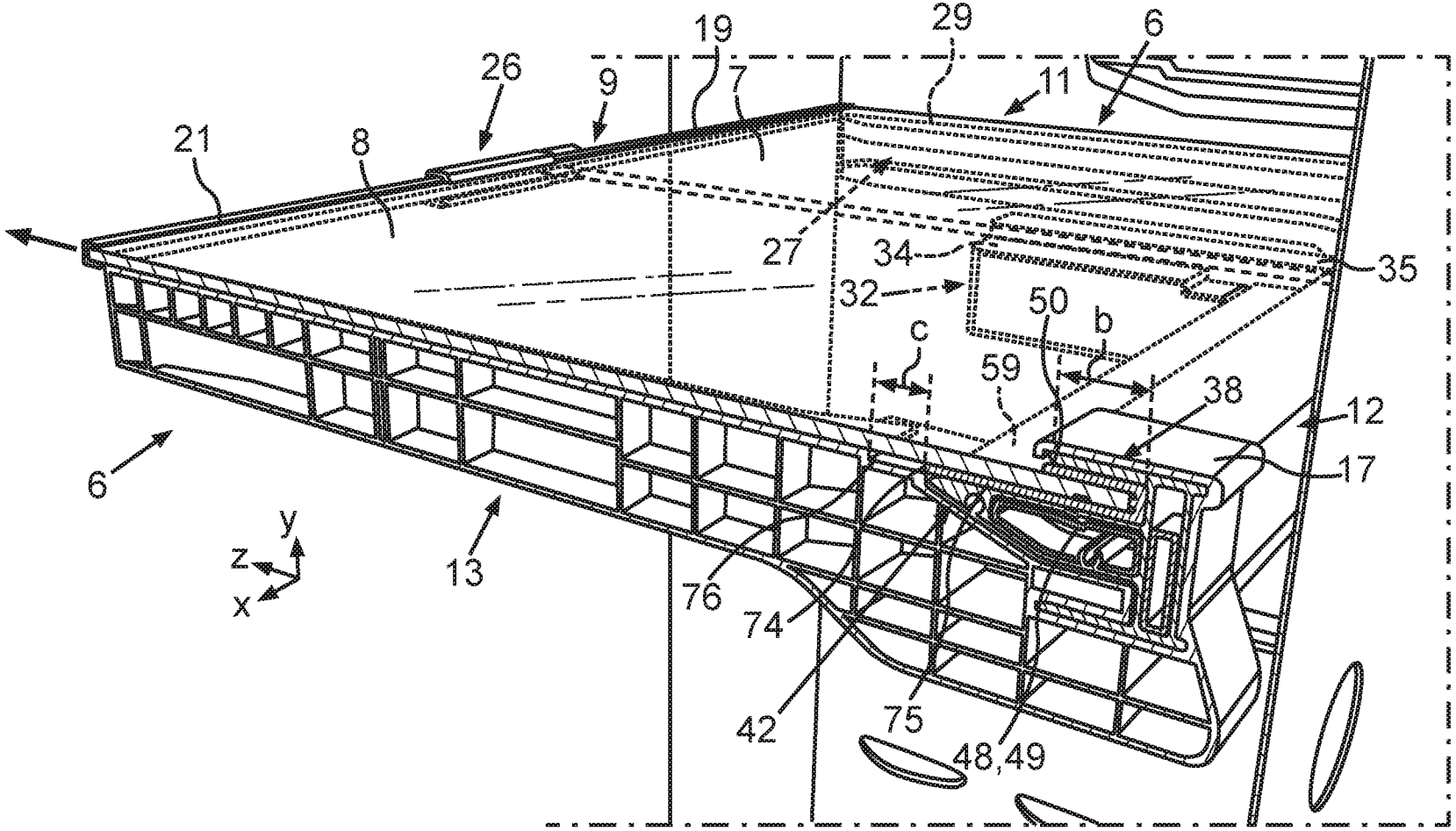
FIG. 14 is a fragmentary, perspective sectional view through the shelf in the region of a second side frame element provided to hold the second plate element.

FIG. 14 shows a perspective sectional view of the shelf 6. The second side frame element 13 is shown in a vertical sectional view in this case, as is the second plate element 8. The two plate elements 7 and 8 are shown in a use position therein. The end position of the second plate element 8 is shown. A depth b of the grooved holder 38 measured in a depthwise direction is shown. A distance c is also shown. The distance c is measured in a depthwise direction between a front edge 74 of a lower arm 75 of the edge protection element 25 and a stop edge forming a pull-out stop 76. The pull-out stop 76 is part of a stop integrated in the third frame element 13. The distance c is smaller than the depth b in the end position when the second plate element 8 is in the use position.

Figure 15:
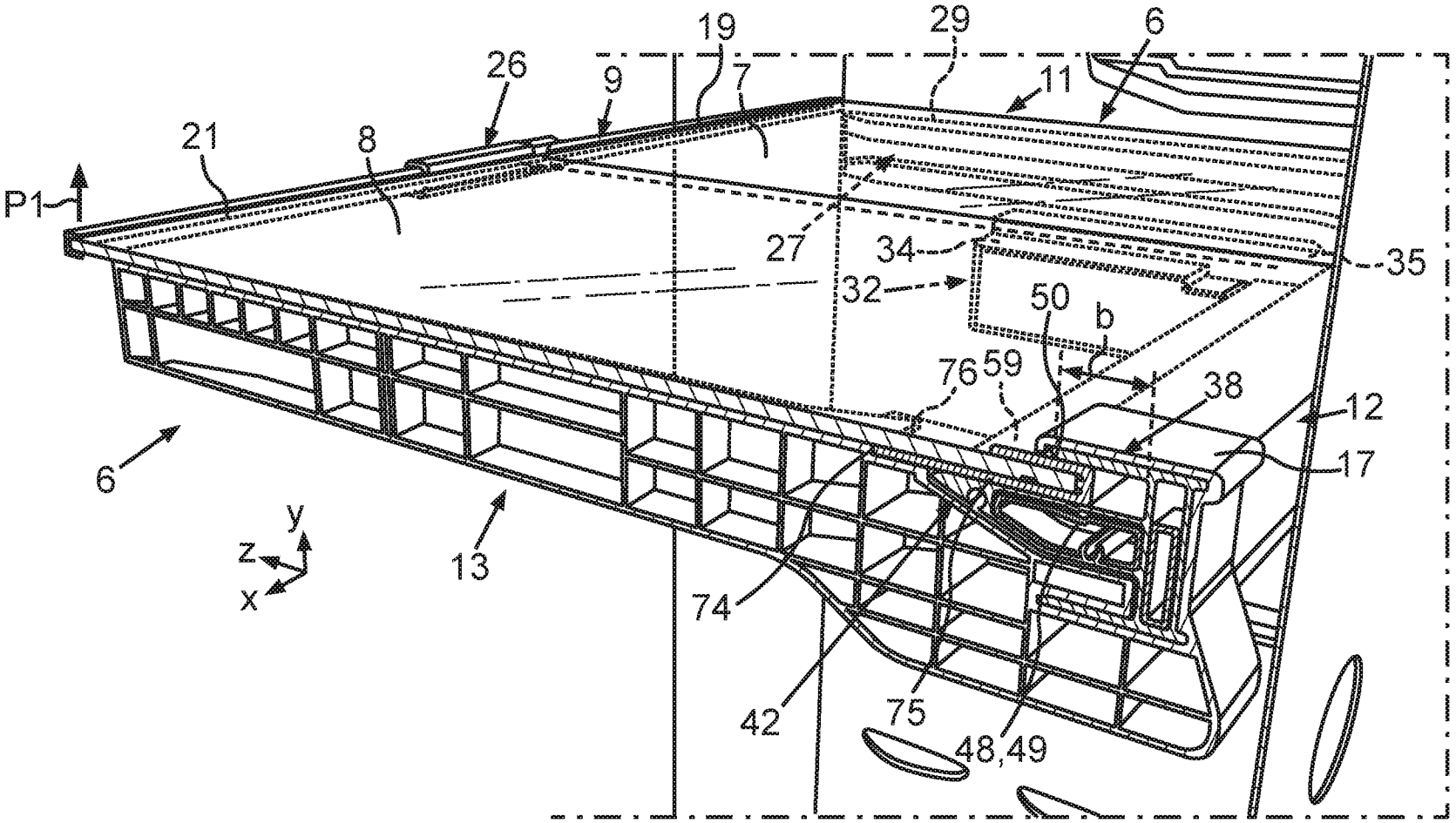
FIG. 15 is a fragmentary, perspective view according to FIG. 14, in which the second plate element is disposed in an intermediate removal position following on from the end position shown in FIG. 14.
Figure 16:
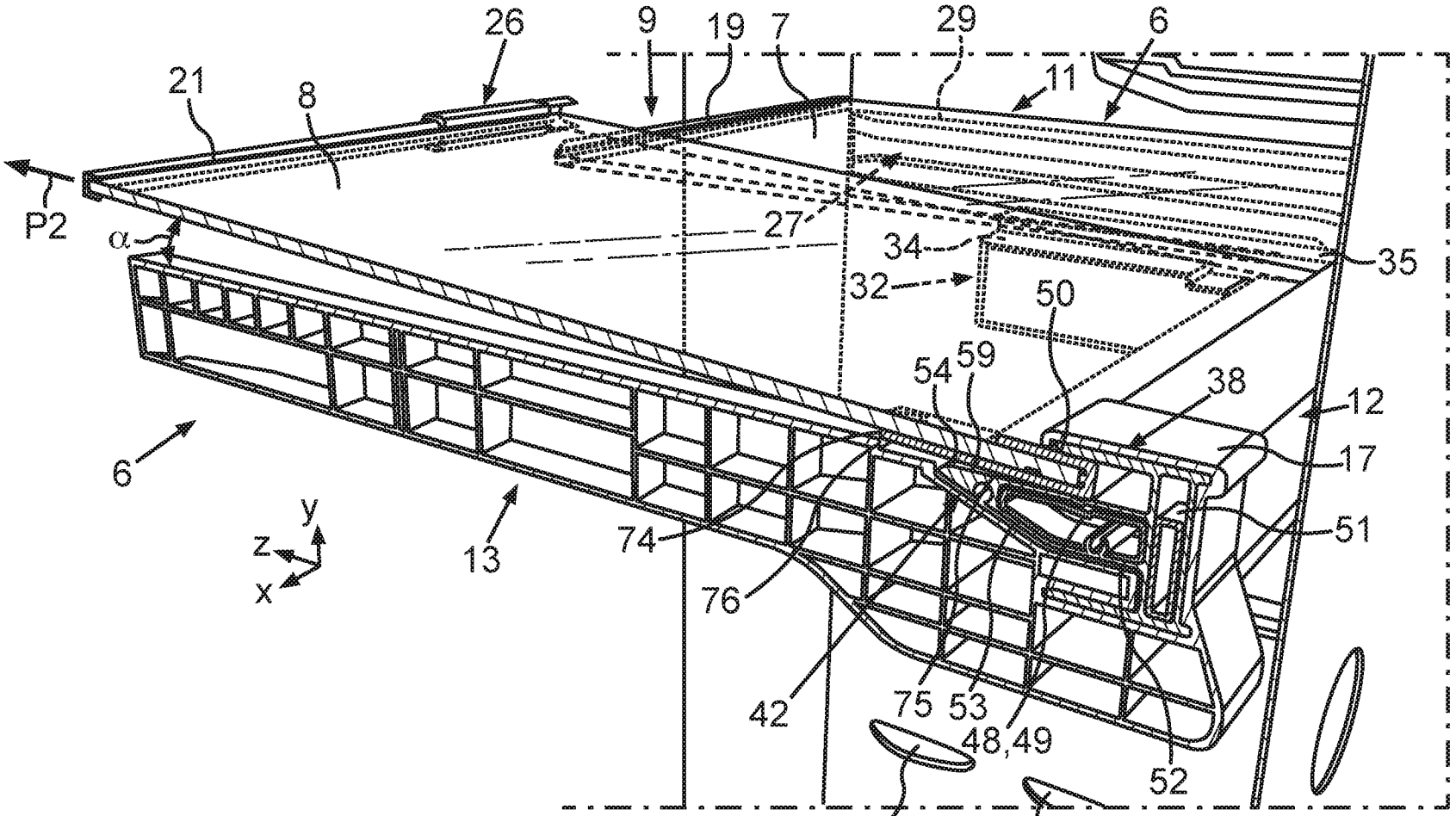
FIG. 16 is a view similar to FIGS. 14 and 15, in which the second plate element is shown in a further intermediate removal position for removal, following on from the position in FIG. 15.

If the second plate element 8 is now moved out of its use position from the view in FIG. 14, into the view in FIG. 15 the second plate element 8 is first drawn forward in a linear manner in a positive z-direction. This results in an intermediate removal position according to FIG. 15. In this intermediate removal position the front edge 74 comes up against the pull-out stop 76. Since the distance c in the view in FIG. 14 is greater than the overlap measured in a depthwise direction, in the intermediate removal position according to FIG. 15 the securing element 26 is decoupled from the first plate element 7. This means that the securing element 26 no longer overlaps with the first plate element 7 in a depthwise direction. In the intermediate removal position according to FIG. 15 however part of the rear region of the plate element 8 is still held in the grooved holder 38. This prevents the second plate element 8 from dropping down in an unwanted manner. From the intermediate removal position shown in FIG. 15 the front edge of the second plate element 8 is raised, as shown by the arrow depiction P1 in FIG. 15, so that a further intermediate removal position is reached according to FIG. 16. A removal angle α is thus established. This is based on the surface offset 48 and the wall 49 and the tapering bevel at the front edge of the wall 39. In the position shown in FIG. 16 the second plate element 8 can be pulled out of the grooved holder 38 in the direction of the arrow P2. This allows the second plate element 8 to be removed from the shelf 6 completely, before it is stowed on the shelf 6 in the non-use position. In particular it is not possible to move the second plate element 8 from the use position to the non-use position or vice versa, without it not being released completely from the carrier frame 10. In particular the removal angle α results from the height of the pull-out stop 76 and the width of the lower arm 75 measured in a depthwise direction.

FIGS. 14 to 15 show the stacked structural parts of the rear frame element 12 on one hand and the second side frame element 13 on the other hand. The screw domes are each shown without the screw elements.

Figure 17:
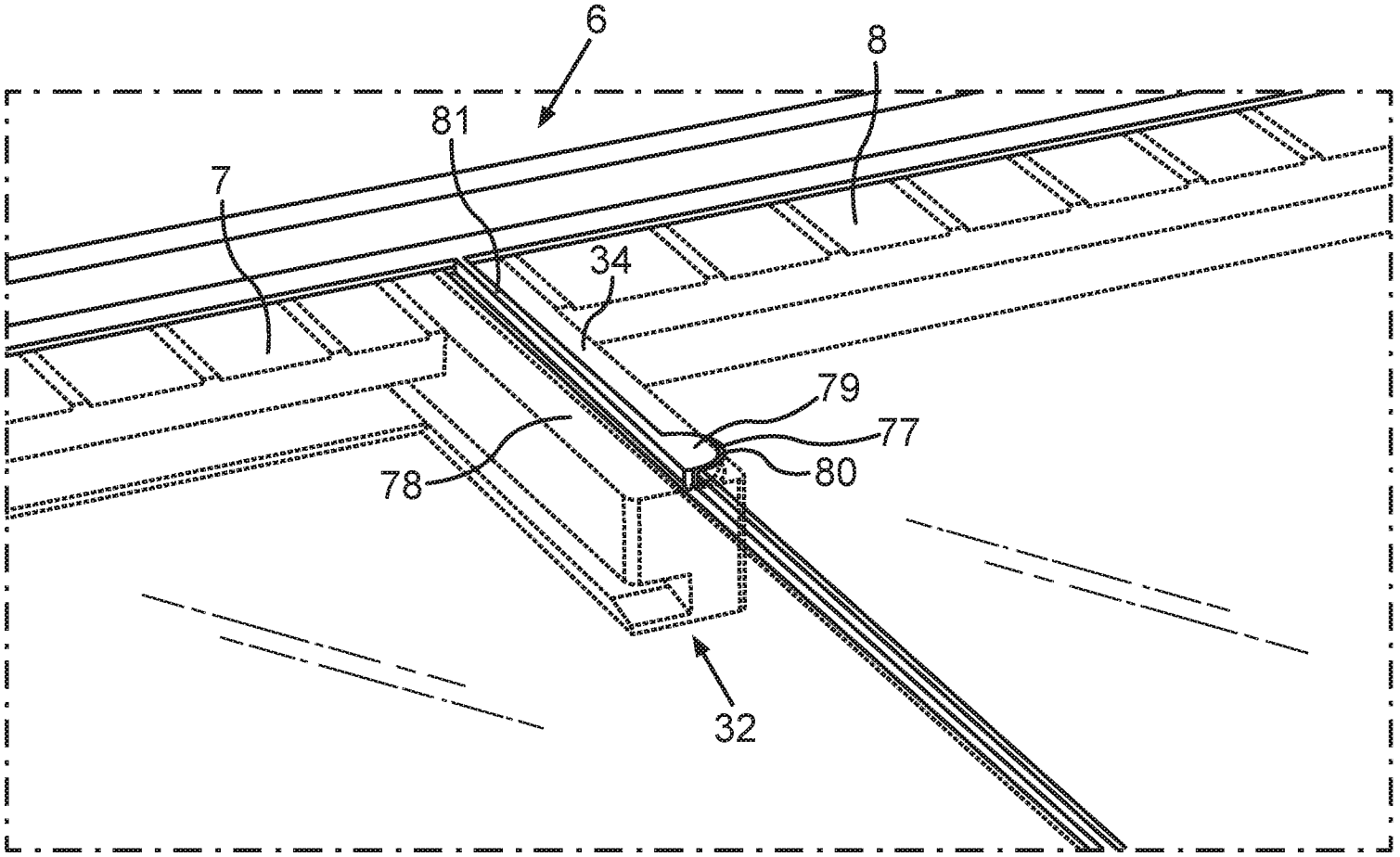
FIG. 17 is a fragmentary, perspective view of a further exemplary embodiment of a shelf.

FIG. 17 shows a further perspective view of a partial detail of a shelf 6. In this embodiment a center web 32 is provided which is configured differently from the embodiments cited above. With this embodiment the bearing plateau or bearing platform 34 is provided in the same manner. A further bearing platform 78 is provided for the first plate element 7. The bearing platform 78 is open at the top. There is therefore no groove 36. A pull-out protector of the second plate element 8 is also provided in a depthwise direction in the use position shown in FIG. 17. A corresponding rise 79 is configured to project upward. A bulge 77 can be a semicircular disk. This can be a bulge 77 formed in a widthwise direction according to the view in FIG. 17. This engages in a cutout 80 on a side edge of the plate element 8. A web 81 oriented in a depthwise direction is also provided. This serves as an edge stop for both plate elements 7 and 8, when they are disposed in their use positions. With this embodiment the second plate element 8 can be removed from the end position shown in FIG. 17 by raising it at the front in a first step, so that the coupling between the elements 79 and 80 is decoupled. The resulting angled position allows the second plate element 8 to be removed in a forward direction.

Figure 18:
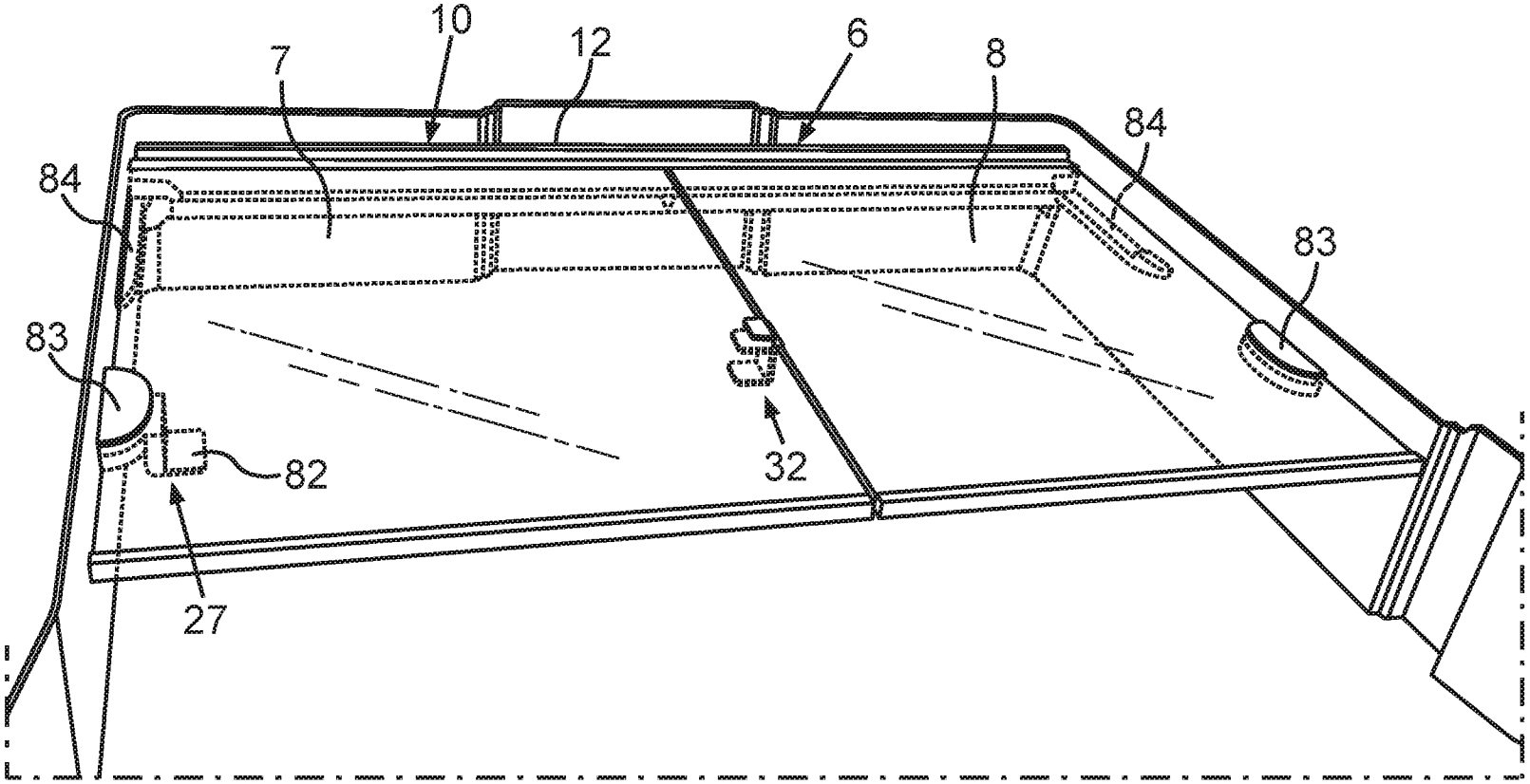
FIG. 18 is a fragmentary, perspective view of a further exemplary embodiment of a shelf.

FIG. 18 shows a perspective view of a further exemplary embodiment of a shelf 6. With this embodiment, provision is made for the carrier frame 10 to have just one rear frame element 12. The side frame elements 11 and 13 are not present in this case. Separate parts 82 are provided in this case to configure a stowage unit 27. A center web 32 with a reduced length is also provided. The part 82 can be disposed on a cam 83, which is configured on a vertical side wall of the inner container 5. For example, it can be attached thereto. Bearing platforms are formed in the center web 32 and the further element 82, with it being possible to rest the second plate element 8 thereon in the non-use position. The center web 32 in this case is at a distance and decoupled from the rear frame element 12. A further cam 84 in particular is shown. This is also integrated in the inner container 5. The first plate element 7 rests on the cam 84 in this case. Cams 83 and/or 84 are configured in the same manner on the opposing side wall of the inner container.

Provision can generally be made for the carrier frame 10 to be made of plastic or metal. Provision can also be made for one frame element to be made of metal and another frame element to be made of plastic. For example, the rear frame element 12 can be made of metal, in particular aluminum. An extruded aluminum profile can be used in this case.

The center web 32 can also be made of plastic or metal. In particular the securing element 26 can be dispensed with when the center web 32 is disposed relatively far forward. The carrier frame 10 can also be produced as a single piece part, for example an injection molded part.

The carrier frame 10 should be seen as a component that is only associated with the shelf 6. The carrier frame 10 therefore has no components that are molded as a single piece or fastened in a fixed position as cams or rails or the like on a vertical side wall or rear side wall of the inner container 5. Such components on an inner container serve as coupling structures, on or to which the shelf 6, in particular with its carrier frame 10, can be positioned and/or coupled. Such components of the inner container 5 that are separate from the shelf are shown for example by the cams 83 and 84 in FIG. 18. These are also shown by way of example in FIG. 3 and FIG. 16. The cams 83, 84 can also be configured differently.

A shelf 6 can also be provided as an accessory or retrofit part. It can therefore also be fitted to an existing household refrigeration appliance 1 at a later stage.

The following is a summary list of reference numerals and the corresponding structure used in the above description of the invention:

| | |
|---|---|
| 1 | Household refrigeration appliance |
| 2 | Housing |
| 3 | Compartment |
| 4 | Door |
| 5 | Inner container |
| 6 | Shelf |
| 7 | Plate element |
| 8 | Plate element |
| 9 | Shelf plate |
| 10 | Carrier frame |
| 11 | Frame element |
| 12 | Frame element |
| 13 | Frame element |
| 14 | Corner region |
| 15 | Corner region |
| 16 | End plate |
| 17 | Cover plate |
| 18 | Front edge |
| 19 | Edge protection element |
| 20 | Front edge |
| 21 | Edge protection element |
| 22 | Rear edge |
| 23 | Edge protection element |
| 24 | Rear end |
| 25 | Edge protection element |
| 26 | Securing element |
| 27 | Stowage unit |
| 28 | Holding groove |
| 29 | Bearing platform |
| 30 | Stop web |
| 31 | Holding groove |
| 32 | Center web |
| 33 | Holding groove |
| 34 | Bearing platform |
| 35 | Retaining part |
| 36 | Groove |
| 37a | Cutout |
| 37b | Cutout |
| 38 | Grooved holder |
| 39 | Upper wall |
| 40 | Boundary wall |
| 41 | Upper wall |
| 42 | Separating web |
| 43 | Lower wall |
| 44 | Lower boundary wall |
| 45 | Hollow space |

-continued

| | |
|---|---|
| 46 | Screw dome |
| 47 | Drilled hole |
| 48 | Surface offset |
| 49 | Wall |
| 50 | Bevel |
| 51 | Hollow chamber |
| 52 | Segment |
| 53 | Segment |
| 54 | Bevel |
| 55 | Bevel |
| 56 | Holding trough |
| 57 | Lower arm |
| 58 | Upper arm |
| 59 | Bearing platform |
| 60 | Stop wall |
| 61 | Hollow region |
| 62 | Base |
| 63 | Snap-fit element |
| 64 | Snap-fit holder |
| 65 | Lower face |
| 66 | Lower boundary wall |
| 67 | Side cover |
| 68 | Base rise |
| 69 | Region |
| 70 | Screw dome |
| 71 | Screw dome |
| 72 | Snap-fit element |
| 73 | Snap-fit holder |
| 74 | Front edge |
| 75 | Lower arm |
| 76 | Pull-out stop |
| 77 | Bulge |
| 78 | Bearing platform |
| 79 | Rise |
| 80 | Cutout |
| 81 | Web |
| 82 | Part |
| 83 | Cam |
| 84 | Cam |
| α | Angle |
| a | Overlap |
| b | Depth |
| c | Distance |
| x | Widthwise direction |
| y | Heightwise direction |
| z | Depthwise direction |
| P1 | Arrow depiction |
| P2 | Arrow |

The invention claimed is:

1. A shelf for a household refrigeration appliance, the shelf comprising:

a shelf plate including a first plate element, a separate second plate element and edges;

said second plate element being disposed next to said first plate element in a widthwise direction of the shelf in a use position to form said shelf plate;

said second plate element being non-destructively removable to make said shelf plate smaller;

a carrier frame bordering said edges of said shelf plate, said carrier frame having side frame elements disposed at sides of the shelf and a rear frame element disposed at a rear of the shelf; and a center web oriented in a depthwise direction of the shelf, said first and second plate elements both resting on said center web in said use position, said center web having a stowage unit with a holding groove into which said second plate element extends in a non-use position;

said center web being connected to said rear frame element and being shorter in the depthwise direction of the shelf than half of each of said side frame elements.

2. The shelf according to claim 1, wherein said center web opens out at said rear frame element.

3. The shelf according to claim 2, wherein said center web is releasably connected to said rear frame element.

4. The shelf according to claim 3, which further comprises at least one of a plug-type connection or a screw connection releasably connecting said center web to said rear frame element.

5. The shelf according to claim 1, wherein said center web has an upwardly open bearing platform on which said second plate element rests in said use position, said center web has a receptacle disposed adjacent said bearing platform with a holding groove, and said first plate element projects into and is held in said holding groove of said receptacle.

6. The shelf according to claim 5, wherein said holding groove of said receptacle has a lower boundary wall with a snap-fit element being snap-fitted into a groove in a lower face of said first plate element.

7. The shelf according to claim 5, wherein said holding groove of said stowage unit is disposed below said receptacle.

8. The shelf according to claim 1, wherein said holding groove has a front end being at least one of upwardly or downwardly widened.

9. The shelf according to claim 1, wherein said holding groove has an uneven lower boundary wall.

10. The shelf according to claim 9, wherein said lower boundary wall has a rear, lowered section.

11. The shelf according to claim 1, wherein said center web has a hollow main body with a side, and said center web has a side cover being separate from said hollow main body, being disposed on said hollow main body, being non-destructively removable from said hollow main body and closing off said side of said hollow main body.

12. The shelf according to claim 1, wherein said carrier frame extends only around three sides of the shelf.

13. The shelf according to claim 12, wherein said rear frame element and said side frame elements are separate components being releasably interconnected.

14. The shelf according to claim 13, wherein said rear frame element and said side frame elements are releasably interconnected by plug connections and screw connections.

15. The shelf according to claim 12, wherein said rear frame element has an upper grooved holder for receiving a rear edge of said first plate element.

16. The shelf according to claim 12, wherein one of said side frame elements has a bearing platform with an open top on which said first plate element rests.

17. The shelf according to claim 12, wherein said rear frame element has an upper grooved holder for receiving a rear edge of said first plate element, and one of said side frame elements has a bearing platform with an open top on which said first plate element rests.

18. The shelf according to claim 12, wherein at least one of said rear frame element or one of said side frame elements and said center web have said stowage unit, and said second plate element is configured to be stowed in said stowage unit below said first plate element in said non-use position.

19. The shelf according to claim 18, wherein at least one of said rear frame element or one of said side frame elements has an integrated holding groove for said stowage unit and said center web has said integrated holding groove of said stowage unit.

* * * * *